US005419091A

United States Patent [19]

Roberts

[11] Patent Number: 5,419,091

[45] Date of Patent: May 30, 1995

[54] POSITIVE-LOCK SLAB SUPPORT

[75] Inventor: Lewis L. Roberts, Ft. Myers Beach, Fla.

[73] Assignee: Mercury Development Corporation, Indianapolis, Ind.

[21] Appl. No.: 143,638

[22] Filed: Nov. 1, 1993

[51] Int. Cl.[6] ..... E04B 2/30; E04C 2/34; E04H 13/00

[52] U.S. Cl. ..... 52/509; 52/134; 52/506.06; 52/513

[58] Field of Search ..... 52/134, 136, 235, 506.03, 52/506.05, 506.06, 508, 509, 513; 403/80, 106, 108, 331, 362, 388

[56] References Cited

U.S. PATENT DOCUMENTS

| | | | |
|---|---|---|---|
| 1,789,576 | 1/1931 | Bowman | 52/509 |
| 2,080,190 | 5/1937 | Sinner | 52/509 |
| 2,302,920 | 11/1942 | Sobie | 52/509 |
| 2,363,156 | 11/1944 | Sinner et al. . | |
| 2,574,938 | 11/1951 | Sinner et al. | 52/509 |
| 2,618,145 | 11/1952 | Sinner et al. | 52/509 |
| 2,769,333 | 11/1956 | Reintjes | 52/509 |
| 2,814,942 | 12/1957 | Sinner et al. | 52/509 |
| 2,853,870 | 9/1958 | Sinner et al. | 52/509 |
| 2,860,504 | 11/1958 | Sinner et al. | 52/509 |
| 3,144,293 | 8/1964 | DeSmidt | 403/362 X |
| 3,213,576 | 10/1965 | Davies | 52/509 |
| 3,342,005 | 9/1967 | Rickards et al. | 52/509 |
| 3,778,942 | 12/1973 | Bondi | 52/509 X |
| 3,897,663 | 8/1975 | Gaul | 52/136 |
| 3,905,169 | 9/1975 | Gallo | 52/509 X |
| 3,961,453 | 6/1976 | Couwenbergs | 52/509 |
| 3,990,199 | 11/1976 | Gallo | 52/509 X |
| 4,064,664 | 12/1977 | Gaul | 52/136 |
| 4,484,422 | 11/1984 | Roberts | 52/137 |
| 4,519,173 | 5/1985 | Roberts | 52/235 |
| 4,523,413 | 6/1985 | Koppenberg | 52/509 X |
| 4,545,167 | 10/1985 | Brock | 52/509 |
| 4,619,094 | 10/1986 | Yang | 52/509 X |

*Primary Examiner*—Carl D. Friedman
*Assistant Examiner*—Kevin D. Wilkens
*Attorney, Agent, or Firm*—Robert A. Spray

[57] ABSTRACT

A locking screw feature provides lockable adjustability for the slab-supporting ledge member which supports the heavy slabs used to form the face-wall of mausoleum crypts. The lockability permits the ledge member to be made to be freely slidable in its receiver slot of the hanger body which is connected to the structural concrete of the building; and the ledge-lockability is achieved by a locking screw which passes inwardly through the ledge member, and is forced against the hanger member, thus permitting the fit of the ledge member to the hanger member to be freely slidable. This combination of features not only accommodates the adjustability to be easy and precisely accurate, but also tightly locks the adjusted position. Preferably, the ledge member passage for the locking screw is provided as a inward extension of the ledge member hole which holds the screw which holds the rosette cap which conceals the junction of the slabs.

10 Claims, 1 Drawing Sheet

POSITIVE-LOCK SLAB SUPPORT

FIELD OF THE INVENTION

The present invention relates to very specialized hardware, and more particularly, to the specialized hardware which supports the heavy marble face-wall panels as of mausoleum crypts, in an arrangement of a whole array of such panels for providing an entire wall.

Even more particularly, the invention relates to and achieves an improvement for the specialized hangers which not only support the heavy panels, but hopefully provide improved means for installation so that the panels are not only supported in a flush manner but also a maximally-aligned manner, for what is considered the most attractiveness.

THE SPECIAL PROBLEM SOLVED BY THE PRESENT INVENTION

The nature of these specialized installations inherently poses specialized problems. That is, the support hanger bodies are fastened to building structures, particularly by being embedded in the building's concrete for sustaining the weight of a portion of adjacent ones of the heavy slab panels, and the hanger bodies extend outwardly for accommodating the attainment of the desired flushness of the array of panels; and the hanger bodies extend laterally outwardly in the form of ledges which support the panels' weight.

For many years, the ledge member providing the seat of each of the panels being supported has been formed from a single piece which for many years has been separate from the hanger body, thus theoretically (at least) to permit horizontal adjustment; but that separateness has not solved the problems of horizontal adjustability. That is, it has seemed that if the ledge member was freely slidable in its carrier slot of the hanger body, the adjusted or set position of the slidable ledge would not always be held or maintained during subsequent steps; but if the fit of the ledge member in its carrier slot is tight in the hanger body, horizontal adjustment of the ledge often required hitting one end of the ledge member with a hammer. This hanger-hitting procedure had many problems, such as non-precision, damage to the ledge member, trial-and-error multiplicity of effort, unlevel seating of one of the supported panels due to the peening effect of repeated hammer blows and their resulting deformation of the ledge member, etc.

The prior art has used a small design body, often called a "rosette", to cover the junction area of the corners of four adjacent panel slabs; and it is retained by a small holding screw extending into a tapped hole in the ledge member; but, prior to the present invention none of the prior art in this very specialized field has provided a double-function of the well-known design use of a rosette feature, heretofore considered solely as an appearance or aesthetic feature, to provide the basis of solution of a long-standing problem, by providing easy and precise lockable horizontal adjustability of the support ledge of a slab-hanger.

As shown more fully herein, the prior art had made several inventions as to embedded slab-hanger details throughout at least a half century; and much of that inventiveness, including earlier inventiveness of this present inventor, have been attempts to provide improved details of improvements in slab-supporting hardware.

Thus, although there have been much inventive activity in what may be considered to be a rather specialized field, the problems with respect specifically to a desirable horizontal adjustability (i.e., problems due to the heaviness of the slabs, the need for flushness and precision both vertically and horizontally) nave remained unsolved until this present invention.

It is against this background, and other prior art factors set forth below, that the present invention is to be logically considered.

BRIEF SUMMARY OF THE INVENTION

The invention is quite specific, and even simple in the sense of directness of concept as to its components, achievement, solution of a specific problem long known to the prior art, and particularly also in making novel and advantageous use of prior art features and knowledge long known to the prior art, yet which prior to this invention has never been conceived in the advantageous combination of this invention's advantageous attainment.

More particularly, the present attainment provides concepts of a locking screw feature which provides and achieves a novel lockable adjustability for the hanger, i.e., for it and the slab-supporting ledge member which supports the heavy slabs used to form the face-wall of mausoleum crypts. Their extreme weight and awkward bulk makes them difficult to handle and position, yet their installed uniformity and regularity of position is considered vital to their attractiveness and usefulness.

The lockability of position, as here achieved by novel means, permits the ledge member to be made to be easily movable, i.e., by being freely slidable in the supportive receiver slot of the ledge-receiver hanger body which provides panel support by being connected to the structural concrete of the building; and the ledge-lockability is achieved by a locking screw which passes inwardly through the ledge member, and is forced against the hanger member by maneuvering it from outside.

This thus permits the fit of the ledge member to the hanger member to be freely slidable for ease of adjustment of the of the ledge member's position, yet the ledge member and the hanger member are tightly connected to advantageously maintain that adjustment of position, as a novel combination concept.

In the preferred form, the ledge member bore for the locking screw is provided as a inward extension of the ledge member's bore or hole which holds the retainer screw which holds the rosette cap which conceals the junction of the slabs.

This combination of set screw and rosette screw bore's threads very economically but effectively provides a novel and advantageous combination of features which not only accommodates the adjustability to be easy but precisely accurate, but also locks the adjusted position as tightly as prior art installations which do not have the ease of adjustment movement; and although the set screw is maneuverable from the outside, no part of the set screw or its hole is visible in the most common installations, i.e., installations of panel walls which use rosettes to conceal the panel junctions, and which support the rosettes by the panel-supporting hardware.

THE PRIOR ART HELPS SHOW PATENTABILITY HERE

In a hindsight consideration of the present invention to determine its inventive and novel nature, it is not only conceded but emphasized that the prior art had details usable in this invention but only if the prior art had had the guidance of the present concepts of the present invention.

That is, it is emphasized that the prior art had/or knew several particulars which individually and accumulatively show the non-obviousness of this combination invention.

Moreover, as to realizing the non-obviousness of this invention now, a look backward to the scores of prior art years seems to show several specific factors for realizing non-obviousness now as to this present invention:

a. The prior art has used set-screws having a locking function for many years;

b. The prior art, all that time, has known that such set-screw devices provide a very convenient way of locking two mechanical components against relative movement;

c. The prior art, for all that time, has known that set-screws provide a permanent fastening, easily installed to a great tightness, and with at least a slight resilient deformation of the threads of either or both the screw or the screw hole, so tight that the mechanical components held together by a set screw will hold together until a substantial torque force is applied, such as to intentionally loosen the components for relative movement including adjustability of their relative location.

d. Set screws are such a common article of hardware that they are well known by surely all manufacturers and users of the specialized hardware for marble slab walls, such as for mausoleums;

e. Surely most if not all manufacturers and installers of marble slab walls have realized problems of slab alignment, which is considered essential for attractiveness of the installation; and they are surely also quite aware of labor costs not only for installation but for much re-work which may be required.

f. Indeed, looking backward from this invention, with the hindsight of the accomplished fact of the present invention, and realizing how nicely it solves a major problem of aligned installation of the heavy and awkward marble slabs, it may seem like the invention has provided what might be called a simple solution of a big problem, even though the entire prior art in this competitive commercial field had not conceived this invention.

g. Simplicity here helps to show the non-obviousness also under the principle that simplicity can be a significant indicator of non-obviousness, for a simplicity of construction is not at all necessarily a simplicity of concept.

h. Although set-screws have indeed been known and used world-wide for scores of years, probably most of them seem supposedly to prevent relative rotation, e.g., locking a wheel, hub, or pulley on an axle shaft, instead of blocking against relative linear travel;

i. Probably only a relatively few devices use two screws which use the same screw hole, as is here the preferred embodiment;

j. Probably only a relatively few devices use two screws which use the same screw hole, as is here the preferred embodiment, especially as in the present invention in which the two screws are entirely unrelated as to function;

k. Here, the same threaded hole desirably provides the retainer function for two male screw bodies of equal thread size and nature; but for the achieving of two quite unrelated functions, the screws have to be separate and independent as to axial movements, so that the rosette may close fully onto the slab junction, and the ledge-tightener screw may jam onto and against the hanger, each fully-pressing position of the respective screw body requiring the fully-pressing of the other screw body to not block its own fully-pressing function.

PARTICULATE OF PRIOR ART AS SHOWING INVENTIVENESS HERE

The prior art for years is represented by the following U.S. Patents:

J. B. Sinner, U.S. Pat. No. 2,080,190, May 11, 1937,

J. B. Sinner, et al, U.S. Pat. No. 2,363,156, Nov. 21, 1944,

J. B. Sinner, et al, U.S. Pat. No. 2,574,938, Nov. 13, 1951,

J. B. Sinner, et al, U.S. Pat. No. 2,618,145, Nov. 18, 1952,

J. B. Sinner, et al, U.S. Pat. No. 2,814,942, December 1957,

J. B. Sinner, et al, U.S. Pat. No. 2,853,870, Sep. 30, 1958,

J. B. Sinner, et al, U.S. Pat. No. 2,860,504, November 1958,

Davies, U.S. Pat. No. 3,213,576, October 1965,

Rickards, et al, U.S. Pat. No. 3,342,005, September 1967,

Bondi, U.S. Pat. No. 3,778,942, December 1973,

Gaul, U.S. Pat. No., 3,897,663, August 1975,

Gallo, U.S. Pat. No. 3,990,199, November 1976,

Gaul, U.S. Pat. No. 4,064,664, December 1977,

Additional prior art has been found to be devices of Aeon Mfg. Co., 929 W. 253rd Street/P.O. Box 351, Harbor City, Calif. 90710.

The present invention provides an advantageous improvement over particularly slab-hanging devices such as those marketed as Models 801 and 802 of the Aeon Company, and various models marketed by Sinner Brothers, Inc., 3459 Hancock Street, San Diego, Calif. 92110, which are commercial structures utilizing one or more concepts of those prior art patents.

This inventor has also provided prior art by his own inventions which resulted in the U.S. Patents:

U.S. Pat. No. 4,484,422, November 1984

U.S. Pat. No. 4,519,173, May 1985

The apparently closest prior art is now particularly mentioned, together with the reasons why the present invention is not suggested by these articles of the prior art:

a. In the Sinner et al. patent '145 a female-threaded body 22 receives in its bore two axially-aligned screws, the outer one of which is the screw-body which carries the rosette. However, the inner screw body is not adjustable from the outside, but only from the inside; and instead of its free end jamming inwardly against the ledge receiver, for accomplishing easy horizontal ledge-adjustability here provided, that prior art jamming function is that of its screw head jamming-outwardly against the ledge body, a different purpose.

b. The patent '938 of Sinner (in its FIG. 5) illustrates the ledge hole which carries the rosette 12 to appear to extend inwardly a substantial distance farther than needed for the rosette to close inwardly against the slab face junction; and in fact the threaded ledge hole-bore extends in the patent drawing to about only 1/16 of an inch. That is a small distance, but the presence of that 1/16 of an inch of blocking material of the ledge shows that this Sinner patent provides no concept of a fully-through hole nor of a inner second screw body which could be manipulated from outwardly to cause its free end to provide easy but tight ledge-adjustability by bearing tightly against the ledge-receiver hanger body.

c. Even the present inventor's own patent '422 shows a ledge-bore 28 which screw-threadedly receives the holding screw 26 of the rosette 24; however, this patent gives no suggestion of the provision of the ledge-bore 28 extending inwardly fully through the ledge body, even though it would be a very easy provision to have provided, and this patent shows no suggestion of a second or inner screw body, which could be manipulatable from the outside to cause it to jam against the ledge-receiver to tightly lock the ledge body to provide fixed horizontal adjustment of the ledge body.

d. The support ledges have been "adjustable", at least since the Sinner patent '145 of 1952; but not as provided by the present invention. Even in the 1984 Roberts patent '422, the ledge body was adjustable in the hanger's carrier slot; but no screw type locking means.

In spite of all such factors of the prior art, the problem here solved awaited this inventor's creativity. More particularly, as to the novelty here of the invention as considered as a whole, a contrast to the prior art helps show its contrast to the present concepts, and emphasizes the advantages and the inventive significance of the present concepts as are here shown.

DESCRIPTION OF THE FIGURES OF THE DRAWINGS

The above description is of somewhat introductory and generalized form. More particular details, concepts, and features are set forth in the following and more detailed description of an illustrative embodiment, taken in conjunction with the accompanying drawings, which are of somewhat schematic and diagrammatic nature, and in which.

THE EMBODIMENT AS SHOWN IN THE DRAWINGS

Figure 1:
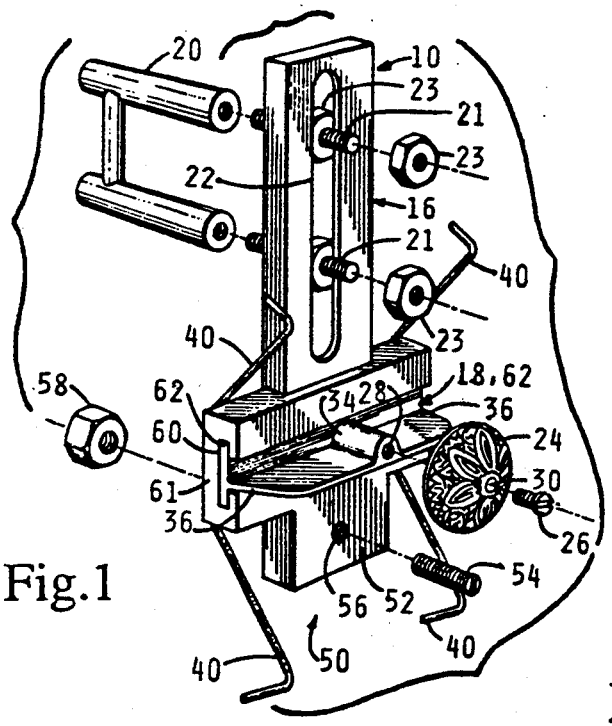
Fig.1 PRIOR ART
FIG. 1 is an exploded pictorial view illustrating a slab-hanging device of the prior art, for being provided with a ledge-adjustability feature of the present invention.
Figure 2:
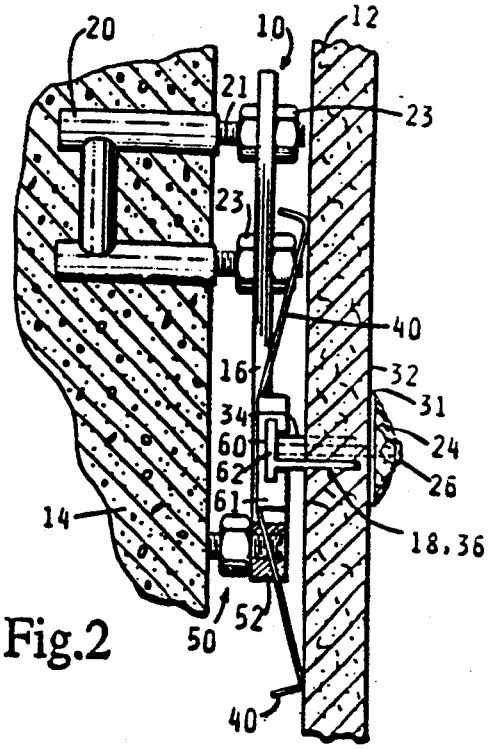
FIG. 2 is a vertical view through the front of a mausoleum crypt installation equipped with the slab-hanging fixture or device of FIG. 1, and in a position supported by the building structure and supporting panel slabs providing a front facing of marble or other facing installation, the view being of cross sectional nature.

This invention provides a significant adjustment feature as an advantageous improvement over slab-hanging means 10 otherwise conventional in the prior art. The slab-hanging means 10 of the prior art is a very specialized device for removably supporting a vertically-arranged series of heavy granite or marble slabs 12 upon associated supporting structure such as of a mausoleum, and here is shown as the front-face concrete wall 14 of a mausoleum crypt.

Conventionally in this specialized use, the slab-hanging means 10 of the prior art is shown as having two primary support pieces of specialized and supportingly-cooperative hardware. I.e., it has a vertical hanger member 16, for supportive attachment of the device to the associated supporting wall structure 14; and at a relatively low portion of the vertical hanger member 16, it has an outwardly-extending ledge means 18 for the supporting of contiguous portions of a pair of the heavy slabs 12.

Supporting the overall device 10, the prior art provides fastener means 20 for the hanger 16, those fasteners being held by being embedded in the associated supporting structure 14, and extending threaded portions 21 supportingly engageable with slot 22 of vertical hanger portion 16 of the device 10, thus fixedly securing the slab-hanging device 10 to the associated supporting structure 14 in whatever is the selected position outwardly of the associated supporting structure 14, accommodating the inevitable irregularities of the concrete crypt wall-face and yet keep a desired attractive flushness of the series of slabe 12. Nuts 23 hold extenders 21 to the wall 16.

Also the prior art provides retainer means shown as a designed cap or head 24 commonly called a "rosette" held by a screw 26 in a ledge-hole 28 for retaining the slabs 12 in their supported position on the ledge member 18. The ledge-hole 28 opens outwardly, accommodating the threaded shank 29 of the screw 26 which when passed through the central bore 30 of the head 24, and tightened in ledge hole 28, pulls the inner face 31 of the head 24 inwardly against the outer face 32 of the panels 12. This covers this junction of slabs 12 and covers the ledge hole 28 and the portion of the ledge 18 which contains the ledge hole 28, that ledge portion being an integral cylindrical boss 34 which, with its hole 28, runs fore-and-aft along the top of the horizontal flange 36 of the ledge member 18. (It is the ledge-flange 36 upon which the panels 12 seat.)

The prior art has other features, which are mentioned for a more full understanding of the embodiment shown. These other details include a pressure spring 40 for applying a tight pressure on the slabs 12; and also shown is an auxiliary support means 50 in the lower portion 52 of the hanger 16, this auxiliary support means 50 shown comprising a screw 54 in a threaded hanger opening 56, the screw 54 being adjustable when rotated to put a compression force in the screw 54 which gives a compressive outward support to the hanger portion 52, opposing a tendency of the heavy slabs 12 to sag, and the adjustment of the screw 54 is shown as holdable by a jam nut 58.

It is with such a prior art slab-hanging device 10 that the concepts of the present invention are here shown, and which device 10 is substantially improved.

According to the present invention's concepts, slab-hanging means 10 of such prior art is advantageously provided with a novel and advantageous feature by which the ledge 18 is adjustably movable to, and fixedly held, in whatever horizontally adjusted position is desired.

More particularly, as to the present invention, the ledge member 18 is made to have a freely-movable fit in the vertical slot 60 of the hanger 16's horizontally-extending support portion 61, the free fit being along all the adjacent portions of the ledge 18 and hanger 16.

That is, the ledge 18 is easily adjusted horizontally by the installer causing it to slide lengthwise of the slot 60.

Cooperating with that free fit feature, the hole 28 which holds the shank 29 of the rosette's holding screw 26 is made to extend fully inwardly, i.e., through the inner wall 62 of the ledge member 18 (it being a vertical stiffener wall 62 embraced by the horizontally extending hanger slot 60), as well as the portion of the hole 28 in the prior art's cylindrical boss 34 mentioned above. All portions of the hole 28 are shown co-axial, and of the same thread size and nature in the form shown, for economy of production.

A locking screw 70 (as a set screw) is provided for the hole 28 inwardly of the outer portion of the hole 28 which the prior art provides for the accommodation of the rosette 24's holding screw 26's shank 29. The screw 70 is an auxiliary screw, and, although it is in the same bore 28 as the shank 29 of the rosette screw 26, it is for an entirely different purpose than that of the rosette screw 26, even though it is maneuverable from outwardly of the ledge 18 and its boss 34.

More particularly, the auxiliary screw 70 is manipulatable by a tool (not shown) which would be inserted inwardly of the outward opening of the hole 28.

Figure 3:
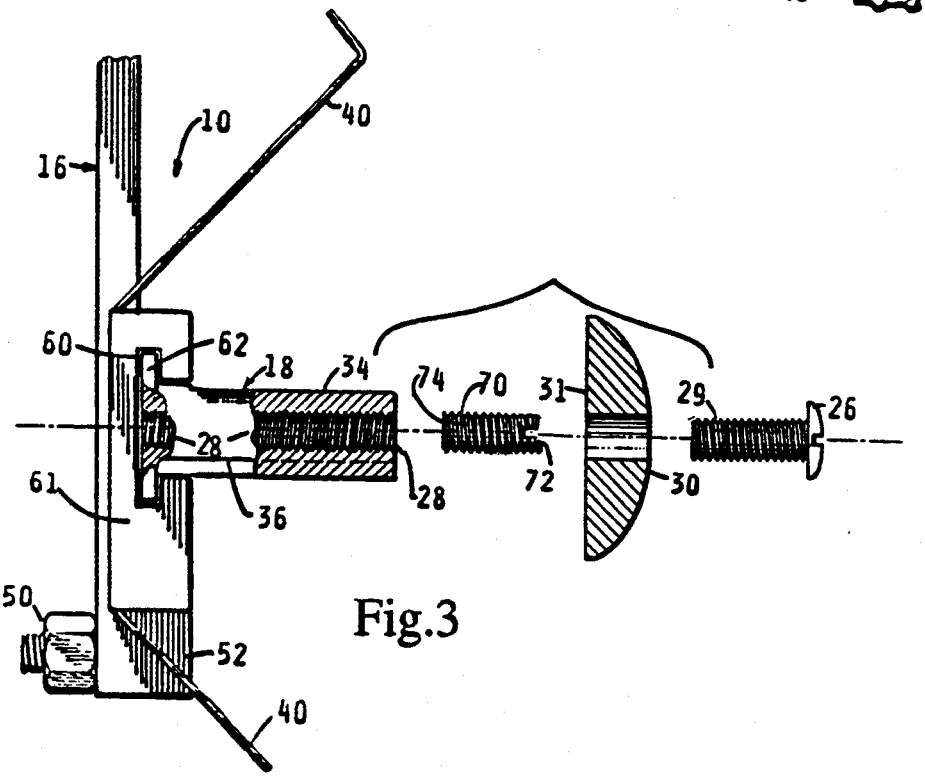
FIG. 3 is a vertical cross-sectional view, of exploded view nature, of the parts illustrating the concepts of the adjustability feature of the present invention, i.e., the hanger body, the ledge member body with its "through" hole, and the second or auxiliary screw which locks the hanger and ledge bodies, that lockability of the hangers and ledge bodies being concealed by the rosette which conceals the slab junction.

Rotation of the screw 70, as caused by the tool, is accomplished by whatever type of screwdriver or Allen-head or other nature of wrench appropriately mates with the locking screw 70's head 72, shown in FIG. 3 merely as a conventional transverse slot.

By the rotation of locking screw 70 to force it inwardly, the threads of the ledge-hole 28 force the inner or free end 74 of the locking screw 70 to bear tightly against the outwardly facing wall 60 of the hanger body 16, securely locking the ledge member 18 with whatever horizontal adjustment is desired with respect to the hanger 16.

SUMMARIZED REVIEW OF ACHIEVEMENTS

Great precision of location of ledge 18 and its hole 28 is very advantageous; for the ledge 18's hole-providing component body 34 is desirably very small, for its very presence has to be accommodated by knocked-off corners of the slabs 12 adjacent that slab-support location.

If the ledge 18 is not fixed horizontally so as to be precisely aligned with the vertical alignment of the upper slabs, the knocked-off corners of the slabs cannot accommodate the slabs to be precisely vertically aligned with respect to the upper slabs, unless the slabs would have a knocked off corner of greater size, but that would require an unduly large size of rosette 24 for concealing the holding components of the installations.

Great precision of vertical and horizontal lines of the slab edges is generally considered a requirement for maximum attractiveness of the slab wall.

The support ledges have been "adjustable", at least since the Sinner patent of 1958; but not as provided by the present invention. Even as late as the 1984 Roberts U.S. Pat. No. 4,484,422, the ledge body had a press fit in its carrier slot.

Present adjustability requires hitting the ledge-end with a hammer, which cause problems:

a. Hard to get the ledge body 18 to move, especially to the precise distance required for the knocked off corners of the slab to accommodate the slab over the threaded body 34 which holds the rosette.

b. High precision is required, because the knocked off corners of the slab are desirably only very small, to accommodate their concealment by a small size rosette.

c. The hitting of the ledge sometimes would cause the ledge to travel too far, and the problem then is increased by the requirement to hit the ledge in the opposite direction.

d. The hitting has to be so hard that the relatively soft-metal ledge gets peened over, extending upwardly; and even a small amount of upward extension causes the slab to be cocked by the non-horizontal nature of the ledge 36 upon which the slab rests.

e. A press-fit ledge, if hammered (especially if more than one occasion of hammering), may get so loose that precision of location is even harder to obtain.

f. Labor saving, by ease and quickness of precise adjustment.

g. Material saving, as to bent ledge members and wrongly chipped slabs.

h. The same hole does the double duty of accepting both the locking screw and accepting the rosette-holding screw.

i. Greatly advantageous and adjustable locking power is achieved by a fully concealed nature in essentially no visible space at all, by getting double-duty with the hiding feature, i.e., the rosette, which is already a detail of the typical installation.

j. Although the highly competitive prior art has put up with the "hammering problem" for many years, none of the prior art conceived this advantageous and simple solution.

CONCLUSION

It is thus seen that the slab support concepts, as provided and used according to the concepts herein set forth, provide novel concepts of a desirable and advantageous device, yielding the advantages of lockable horizontal adjustability of the support ledge member of a slab-hanger device which, in overall combination, is conceptually different from the prior art in this specialized field, even though prior art hangers could have used the present adjustment-lockability concepts, or could have been easily adapted to use these concepts, as to their mechanical details as a basic capability, for years, but only if the concepts had been conceived; yet significantly this particular lockability combination, even considered as including or building on prior art concepts, has not been suggested by the prior art, this achievement being a substantial and advantageous departure from prior art, all this even though the prior art snows attempts at improvement and variations as to hanger supports, including even attempts for horizontal adjustability, for many years. And particularly is the overall difference from the prior art significant when the non-obviousness is viewed by a consideration of the subject matter as a whole, as integrally incorporating a combination of features as different from the prior art, in contrast to merely those details of novelty themselves, and further in view of the prior art teaching away from the particular and inter-related concepts and features of the present invention.

In summary as to the nature of these advantageous concepts, their inventiveness is shown by novel features of concept and construction shown here, in novel and advantageous combination, not only being different from all the prior art known, but because the achievement is not what is or has been suggested to those of ordinary skill in the art, especially realistically considering this as comprising components which individually are similar in nature to what is surely well known in the arts of manufacture and use of slab-hanger devices for many years. No prior art has suggested the modifications of any prior art to achieve the novel concepts here achieved, with the lockable adjustability feature providing special function in the overall combination; and this is particularly significant since these devices are objects whose mechanisms, and the set-screw type of operability, are easy to observe, and are not technically sophisticated as to either construction, use, or operative principles, being in contrast quite simple as structure even though not in concept in this specialized field.

Accordingly, it will thus be seen from the foregoing description of the invention according to this illustrative embodiment, considered with the accompanying drawings, that the present invention provides new and useful concepts of a novel and advantageous horizontal adjustability with tight ledge lockability, providing accuracy of slab-alignment by easy and convenient procedure of which the prior art had shown itself to not be capable. The invention yields desired advantages and characteristics and accomplishes the intended objects, including those hereinbefore pointed out and others which are inherent in the invention.

Modifications ant variations may be effected without departing from the scope of the novel concepts of the invention; accordingly, the invention is not limited to the specific embodiment, or form or arrangement of parts herein described or shown.

I claim:

1. Adjustment means for the supporting ledge member means component of slab-hanging means, the slab-hanging means providing support for removably supporting a vertically-arranged series of slabs upon associated supporting structure, the slab-hanging means having a vertical hanger body means for supportive attachment to the associated supporting structure, and having outwardly extending from the hanger body means a ledge member means upon which seat the contiguous portions of a pair of the slabs, the hanger body means and the ledge member means having cooperative retainer means by which the ledge member means is supportively but movably connected to the hanger body means in a manner by which the ledge member means is horizontally movable with respect to the hanger body means, the ledge member means having a hole opening outwardly, and the slab-hanging means having a cover body member and a retainer screw operatively receivable in the ledge member means outwardly-opening hole for retaining the cover body member overlying the junction of slabs, for such a slab-hanging means, the improvement comprising the combination of (a) cooperative retainer means of the hanger body means and the ledge member means having a free fit, providing relative horizontal movement of the ledge member means with respect to the hanger body means, (b) the outwardly-opening ledge member means hole having an inward extension which is open to the outwardly-opening ledge member means hole, and which hole extension opens inwardly onto the hanger body means, (c) the outwardly-opening ledge member means hole having threads, and (d) a second screw member having screw-threaded engagement with the outwardly-opening ledge member means hole, such that the second screw member is manipulatable from outside the ledge member means by a tool passing through the outwardly-opening ledge member means hole, and that such manipulation will cause the second screw member to be forced by the outwardly-opening ledge member means hole threads to bear forceably against the hanger body means, and thereby forceably lock the ledge member means to the hanger body means.

2. The adjustment means as set forth in claim 1, in which the ledge member means is provided with laterally spaced ledges for the seating thereon of the pair of slabs, and is provided also with a boss between the ledge, which boss provides said ledge member means outwardly-opening hole, and the ledge member means is provided along its inward portion with a vertical stiffening wall;

and the improvement also comprises that the ledge member means outwardly-opening hole extends fully through both said boss and the vertical wall of the ledge member means, the ledge member means outwardly-opening hole's extent through said vertical wall providing its inward extension by which it opens inwardly onto the hanger-body means for providing said ledge member means locking operativity of the second screw member.

3. The adjustment means as set forth in claim 2, in which the outward-opening hole and its inward extension are co-axial.

4. The adjustment means as set forth in claim 2, in which the threads, by which the second screw member is forceable into operativity of locking the ledge member means, are of the same size and nature as the threads of the outwardly-opening ledge member means hole.

5. The adjustment means as set forth in claims 3 in which the threads, by which the second screw member is forceable into operativity of locking the ledge member means, are of the same size and nature as the threads of the outwardly-opening ledge member means hole.

6. The adjustment means as set forth in claim 1, in which the threads, by which the second screw member is forceable into operativity of locking the ledge member means, are of the same size and nature as the threads of the outwardly-opening ledge member means hole.

7. The adjustment means as set forth in claim 1, in which the outward-opening hole and its inward extension are co-axial.

8. The adjustment means as set forth in claim 7 in which the threads, by which the second screw member is forceable into operativity of locking the ledge member means, are of the same size and nature as the threads of the outwardly-opening ledge member means hole.

9. Adjustment means for the supporting ledge member means component of slab-hanging means, the slab-hanging means providing support for removably supporting a vertically-arranged series of slabs upon associated supporting structure, the slab-hanging means having a vertical hanger body means for supportive attachment to the associated supporting structure, and having outwardly extending from the hanger body means a ledge member means upon which seat the contiguous portions of a pair of the slabs, the hanger body means and the ledge member means having cooperative retainer means by which the ledge member means is supportively but movably connected to the hanger body means in a manner by which the ledge member means is horizontally movable with respect to the hanger body means, the ledge member means having a hole opening outwardly, and the slab-hanging means having a cover body member and a retainer screw operatively receivable in the ledge member means outwardly-opening hole for retaining the cover body member overlying the junction of slabs, for such a slab-hanging means, the improvement comprising the combination of (a) cooperative retainer means of the hanger body means and the ledge member means having a free fit, providing relative horizontal movement of the ledge member means with respect to the hanger body means, (b) the ledge member means having an auxiliary hole in the ledge member means, co-axial with said ledge member means outwardly-opening hole, and opening outwardly of the ledge member means by opening to the outwardly-opening ledge member means hole and to the hanger body means, for access from outside of the ledge member means, and having threads, and (c) a second screw member having screw-threaded engagement with the ledge member means auxiliary hole, such that the second screw member is manipulatable from outside the ledge member means by a tool passing inwardly of the ledge member means from the outside, through the outwardly-opening hole, for causing the second screw member to be forced by the auxiliary hole threads to bear forceably against the hanger body means, and forceably lock the ledge member means to the hanger body means.

10. The adjustment means as set forth in claim 9, in which the threads, of the auxiliary hole, by which the second screw member is forceable into operativity of locking the ledge member means, are of the same size and nature as the threads of the outwardly-opening ledge member means hole.

* * * * *

UNITED STATES PATENT AND TRADEMARK OFFICE

CERTIFICATE OF CORRECTION

PATENT NO. : 5,419,091

DATED : May 30, 1995

INVENTOR(S) : Lewis L. Roberts

It is certified that error appears in the above-identified patent and that said Letters Patent is hereby corrected as shown below:

Col. 2, line 6; "nave" should be "have"

Col. 4, line 11; "Particulate" should be "Particulars"

Col. 8, line 51; Change "snows" to "shows"

Col. 9, line 26; Change "ant" to "and"

Col. 9, line 31; Change "I Claim" to "CLAIMS"

Col. 10, line 16; Change "ledge" to "ledges" (1st word)

Col. 10, line 37; Change "Claims" to "Claim"

Signed and Sealed this

Twelfth Day of September, 1995

*Attest:*

Bruce Lehman

BRUCE LEHMAN

*Attesting Officer*

*Commissioner of Patents and Trademarks*